US006220355B1

(12) United States Patent
French

(10) Patent No.: US 6,220,355 B1
(45) Date of Patent: Apr. 24, 2001

(54) DOWNHOLE APPARATUS

(75) Inventor: Clive John French, Aberdeen (GB)

(73) Assignee: Ocre (Scotland) Limited (GB)

( * ) Notice: Subject to any disclaimer, the term of this patent is extended or adjusted under 35 U.S.C. 154(b) by 0 days.

(21) Appl. No.: 09/125,583

(22) PCT Filed: Feb. 21, 1997

(86) PCT No.: PCT/GB97/00495

§ 371 Date: Feb. 17, 1999

§ 102(e) Date: Feb. 17, 1999

(87) PCT Pub. No.: WO97/33069

PCT Pub. Date: Sep. 12, 1997

(30) Foreign Application Priority Data

Feb. 21, 1996 (GB) ..... 9603677

(51) Int. Cl.[7] ..... E21B 43/11
(52) U.S. Cl. ..... 166/297; 166/55; 175/4.6
(58) Field of Search ..... 166/297, 298, 166/55, 55.1; 175/4.55, 4.56, 4.57, 4.6

(56) References Cited

U.S. PATENT DOCUMENTS 4,747,201 * 5/1988 Donovan et al. ..... 175/4.6
4,889,183 * 12/1989 Sommers et al. ..... 175/4.6
5,070,943 * 12/1991 Walker et al. ..... 175/4.6

* cited by examiner

*Primary Examiner*—William Neuder
(74) *Attorney, Agent, or Firm*—Gifford, Krass, Groh, Sprinkle, Anderson & Citkowski, P.C.

(57) ABSTRACT

Apparatus for perforating a section of liner intersecting a hydrocarbon-bearing formation comprises a length of tubing, the wall of the tubing defining a plurality of apertures, and perforating charges being located in the apertures. The tubing is adapted for mounting on the lower end of a length of production or test tubing such that the formation fluid may flow into the tubing and then directly into the production or test tubing. The charges disintegrate on detonation to leave the apertures unobstructed and to form light or small parts which may be swept out of the well by the formation fluid. Following detonation of the charges, the flow area of the tubing corresponds to the tubing internal diameter.

20 Claims, 8 Drawing Sheets

DOWNHOLE APPARATUS

This invention relates to downhole apparatus, and in particular but not exclusively to apparatus for use in sealing and locating a length of tubing within a casing-lined borehole. The invention also relates to a perforating system.

Boreholes drilled to gain access to underground hydrocarbon-bearing formations are typically lined over most of their length by steel casing. If tests are to be carried out on a hydrocarbon-bearing formation, or oil or gas is to be extracted from the formation, test or production tubing is lowered into the borehole, and fluid communication with the surface is achieved through the tubing. Conventionally, the tubing is located relative to the casing, and the annulus between the casing and the tubing sealed, using one or more expandable or inflatable packers. Such packers are set when the tubing is in position in the borehole by, for example, inflating the packers with pressurised well fluid. Such setting operations may be time-consuming and often encounter difficulties. Further, the tubing consists of a plurality of threaded sections and the tubing must be tested for pressure integrity as the sections are made up and lowered into the borehole. Such "completion" testing is achieved by pressurising the tubing using well fluid, which may result in inflation and premature setting of the packers.

It is among the objects of embodiments of the present invention to provide an apparatus and a method for sealing and locating tubing in casing which obviate or mitigate the above-mentioned disadvantages.

The section of casing or liner which intersects the hydrocarbon-bearing formation is initially solid, to prevent the production fluid from flowing into the bore until the production tubing is in place and all of the associated apparatus and systems have been prepared. The liner is perforated by explosive charges or guns, typically spaced individual charges which are lowered into the bore and detonated at an appropriate location. The charges may be lowered into the bore on electric wireline, slickline or coiled tubing. However, as the length of the perforating guns which may be used is limited by the depth of the safety valve in the wellbore, and the length of liner to be perforated is generally longer than this depth, a perforating operation will tend to involve a number of runs and thus is relatively time consuming. Further, it is desirable to carry out "underbalanced" perforating, in which the pressure within the wellbore is lower than the formation pressure such that, following perforation, the debris produced by the perforating operation is washed out of the wellbore by the higher pressure formation fluid. In the absence of such a pressure differential the debris may be pushed into the perforations, restricting the flow of production fluid into the wellbore. When carrying out a perforating operation using wireline, slickline or coiled tubing which requires a number of runs only the first perforating operation may be underbalanced.

Guns have been mounted on the lower end of production tubing, thus reducing the need for separate runs and separate perforating operations. However, the remains of the charges and firing arrangements which occupy the wellbore following the perforating operation reduces the internal area of the tubing, thus reducing the production capability of the well. This debris may be milled out, such that it falls to the bottom of the well. However, to accommodate the debris from several thousand meters of perforating guns requires the drilling of a substantial extra section of bore, which may take several weeks' drilling, adding substantially to the drilling cost for the wellbore.

It is among the objectives of embodiments of the present invention to obviate or mitigate these difficulties.

According to the present invention there is providing perforating apparatus comprising a length of tubing, the wall of the tubing defining a plurality of apertures, and perforating charges being located in the apertures.

The invention also relates to a perforating method utilising such apparatus.

In use, when the charges are detonated, the charges disintegrate to leave the apertures clear and to permit formation fluid to flow through the apertures into the tubing. The use of tubing as a mounting for the charges allows a perforating "gun" of considerable length (typically 4000 to 7000 m) to be provided, such that a wellbore may be perforated in a single operation, facilitating underbalance perforating.

The tubing is preferably mounted on the lower end of a length of production or test tubing such that the formation fluid may flow into the tubing and then directly into the production or test tubing.

Preferably, the charges disintegrate on detonation to form light or small parts which may be swept out of the well by the formation fluid.

Preferably also, following detonation of the charges the flow area of the tubing corresponds to the tubing internal diameter.

Preferably also, each charge is locatable in a respective aperture from the tubing exterior. Each charge may include a cap adapted to engage with the respective aperture.

Preferably also, the charges are linked by explosive transfer means for communicating a detonation signal to each charge. Most preferably, the explosive transfer means extends through the interior of the tubing. The transfer means will typically be in the form of one or more tracks of detonation cord.

Preferably also, the tubing is provided in separable tubing sections, each section carrying a number of charges.

The sections may be connected by any suitable means, but are preferably connected by threaded collars rotatably mounted on the end of one section for engaging a corresponding threaded portion on the end of an adjacent section. Preferably also, the sections are provided with connectors for explosive transfer means for linking the charges in adjacent guns. Most preferably, the connectors include booster and may define female booster connection and receive a respective end of a central male booster connection portion. Most preferably, the male booster connection portion may be located in the female booster connections after the tubing sections have been placed end-to-end.

Preferably also, the apparatus includes firing means for initiating detonation of the charges. The firing means may be activated by one or more of electrical, hydraulic or mechanical means.

Preferably, the firing means is provided in combination with a valve, such as our Full Bore Isolation Valve (FBIV) as described in PCT\GB97\00308, the disclosure of which is incorporated herein by reference. Most preferably, the valve includes a valve portion, preferably a valve seat, which is movable on pressure being bled off above the valve and the valve opening, which movement of the valve seat releases a firing pin actuating arrangement. The firing pin actuating arrangement preferably incorporates a spring tending to bias the firing pin to a firing position, which spring is released by upward movement of the valve seat. Alternatively, the firing pin may itself be hydraulic pressure actuated, and may be initially retained in a primed position by a rupture disc or retainer which is releases the firing pin on application of a predetermined fluid pressure thereto.

Preferably also, a plug is provided at the end of the tubing, which plug is blown from the tube when the charges are detonated.

According to the another aspect of the present invention there is provided apparatus for locating and sealing tubing in a casing-lined borehole, the apparatus comprising:

a length of tubing;

a sleeve mounted on the tubing; and the sleeve carrying landing means for engaging a restriction in the casing, locking means for locking the sleeve relative to the casing, and sealing means for sealing the sleeve relative to the casing.

In use, the sleeve may serve an equivalent function to a conventional packer, that is locating and sealing the tubing relative to the casing (as used herein, the term "casing" is intended to encompass any liner provided in a borehole). The tubing may be in the form of test tubing or production tubing.

Preferably, the sleeve is formed of a rigid material, typically steel. Thus, it is relatively easy to provide fluid communication passages, or control lines, through the sleeve.

Preferably also, the sleeve is releasably retained on the tubing, such that the tubing may be moved relative to the "set" sleeve and may be retrieved from the borehole while the sleeve remains fixed in the casing.

Preferably also, at least one of the sleeve and tubing carries a seal for slidably engaging the other of the sleeve and tubing.

Preferably also, the sleeve defines means for engaging a retrieval tool: such means may be in the form of a J-slot, such that a tool may be lowered and manipulated to engage the sleeve, further manipulated to release the locking means, and then pulled to retrieve the sleeve.

Preferably also, the landing means is defined by a landing sleeve. Most preferably, the sealing means and locking means are carried by the landing sleeve. In the preferred embodiment, the sealing means and locking means are activated by upward longitudinal movement of the landing sleeve relative to the sleeve on the landing sleeve engaging and being restrained against further longitudinal movement by its engagement with a casing restriction. The landing sleeve may be initially releasably retained relative to the sleeve by, for example, a shear pin or bolt. Preferably, ratchet means are provided between the landing sleeve and the sleeve for maintaining the relative longitudinal positioning therebetween. The ratchet means may be releasable by rotation of the sleeve relative to the landing sleeve; on releasing the ratchet means the landing sleeve is free to move relative to the sleeve and the locking means and the sealing means may be de-activated, releasing the sleeve from the casing.

Preferably also, the casing defines the restriction, and further may define profiles for receiving and cooperating with the locking means and sealing means.

In one embodiment of the invention perforating guns may be mounted on the lower end of the tubing. Preferably, the guns are mounted on hollow tubing of the same or similar internal diameter to the tubing. Most preferably, the guns are full-bore, with strip gun-type charges embedded into hollow tubing. Alternatively, the guns may be mounted on the sleeve itself; the sleeve is capable of supporting a large amount of weight, and the guns will not then restrict the bore diameter and will permit tubing to be run into the bottom of the sump. The perforating guns may be made in accordance with the first aspect of the present invention.

According to another aspect of the present invention there is provided a method of sealing and locating tubing in a casing-lined borehole, the method comprising:

locating a sleeve on a length of tubing with a seal therebetween;

running the tubing into a borehole lined with casing until the sleeve engages a restriction in the casing, the engagement with the casing activating sealing means and locking means on the sleeve to sealingly locate the sleeve in the casing; and releasing the sleeve from the tubing.

These and other aspects of the present invention will now be described, by way of example, with reference to the accompanying drawings, in which:

FIG. 2 is an enlarged sectional view of the apparatus of FIG. 1, during run-in;

Figure 5:
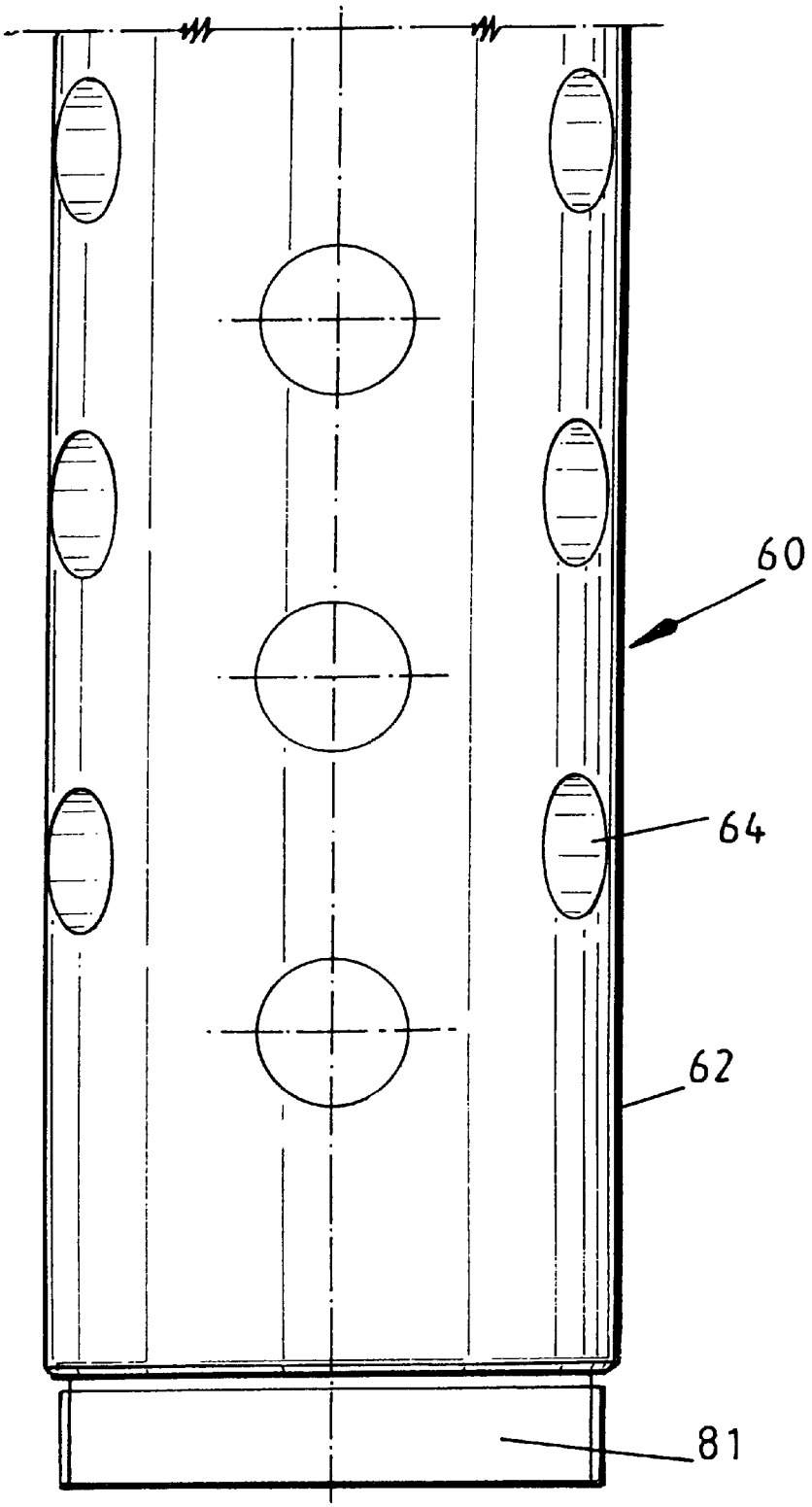
FIG. 5 is a side view of the lower end of a perforating gun section of perforating apparatus in accordance with another aspect of the present invention.
Figure 6:
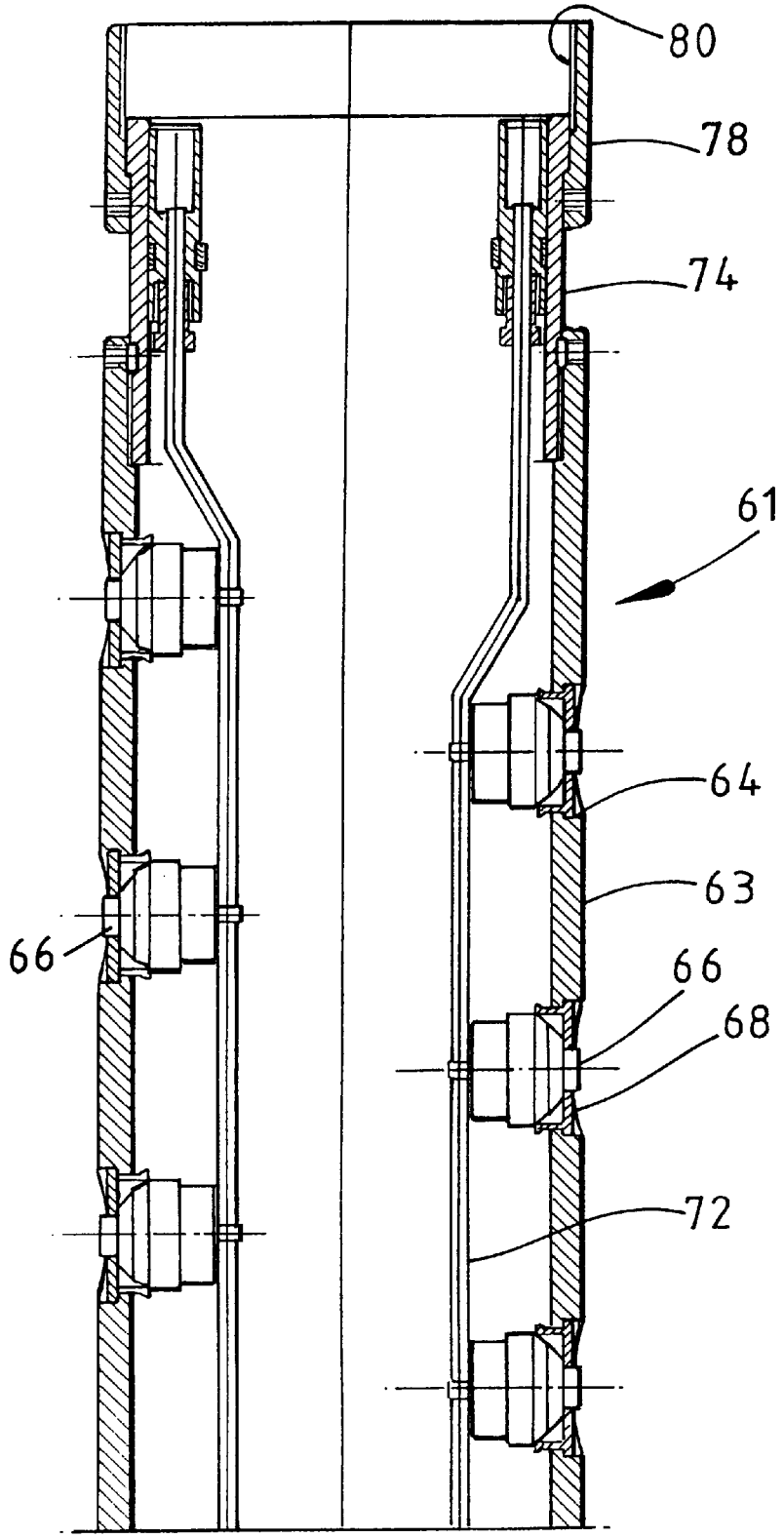
FIG. 6 is a sectional side view of the upper end of a perforating gun section.
Figure 7:
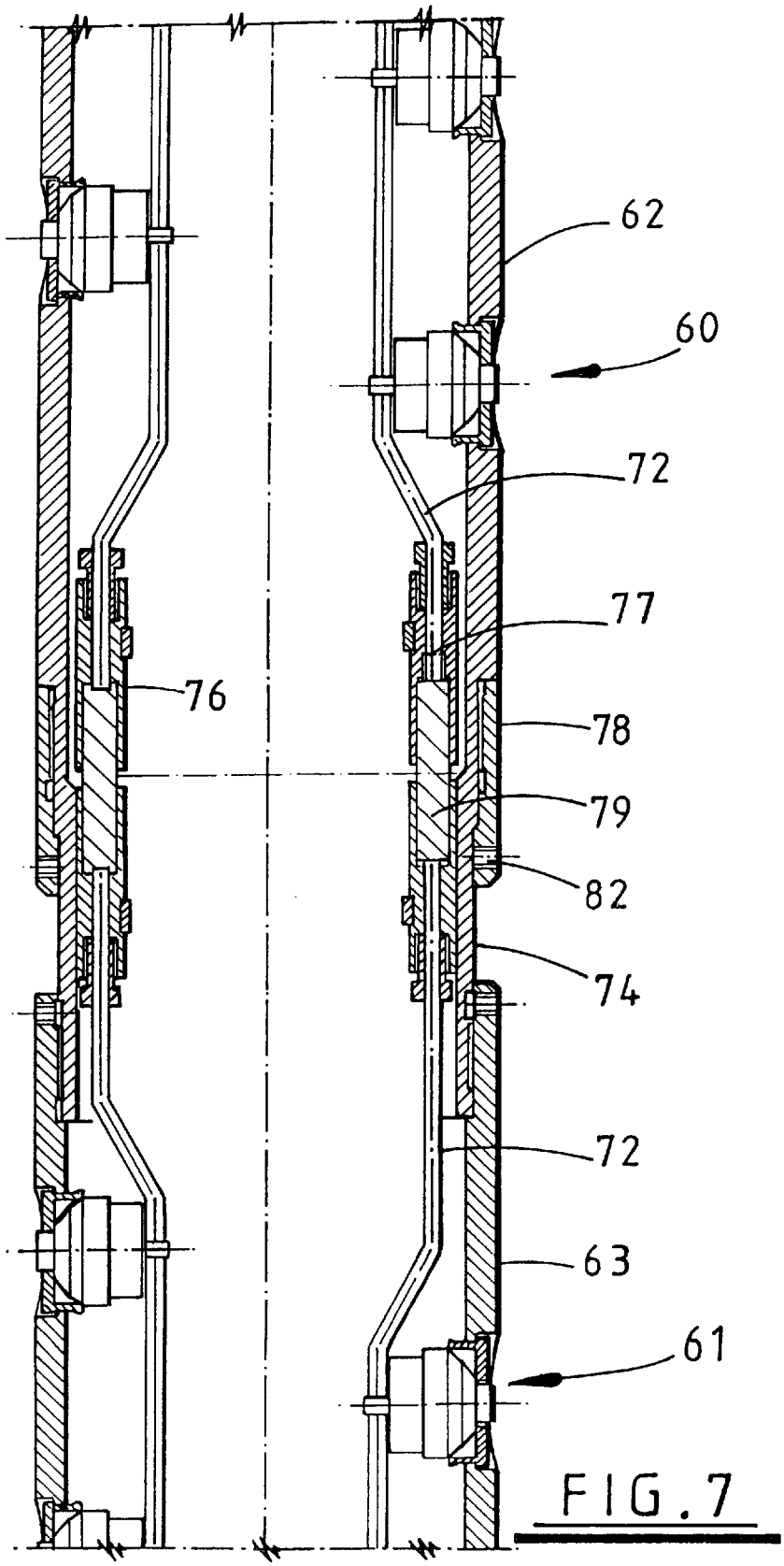
FIG. 7 is a sectional side view of two connected gun sections.
Figures 8A, 8B, 8C:
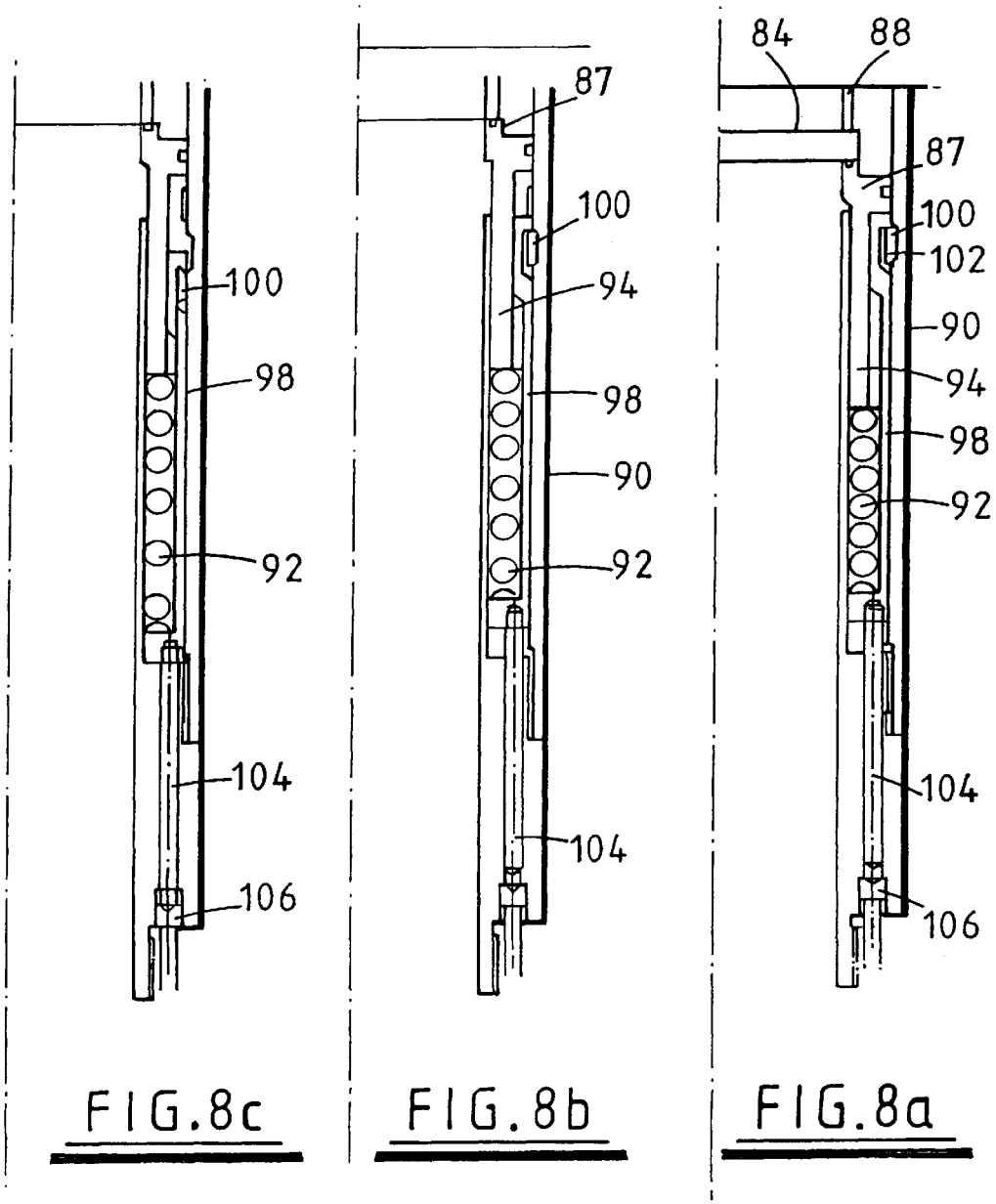
Figure 9B:
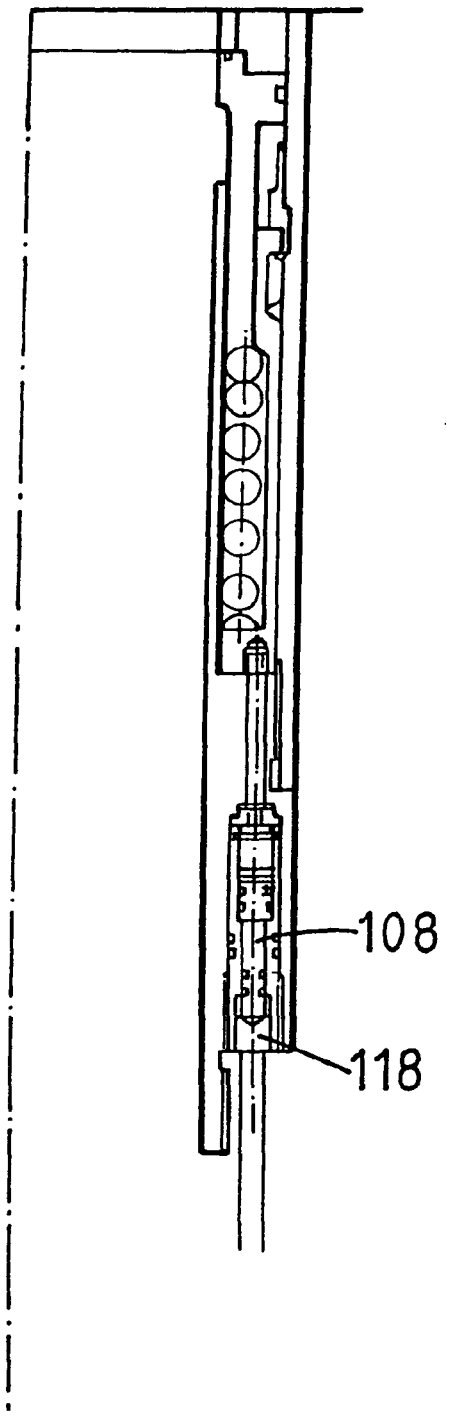
Figure 9A:
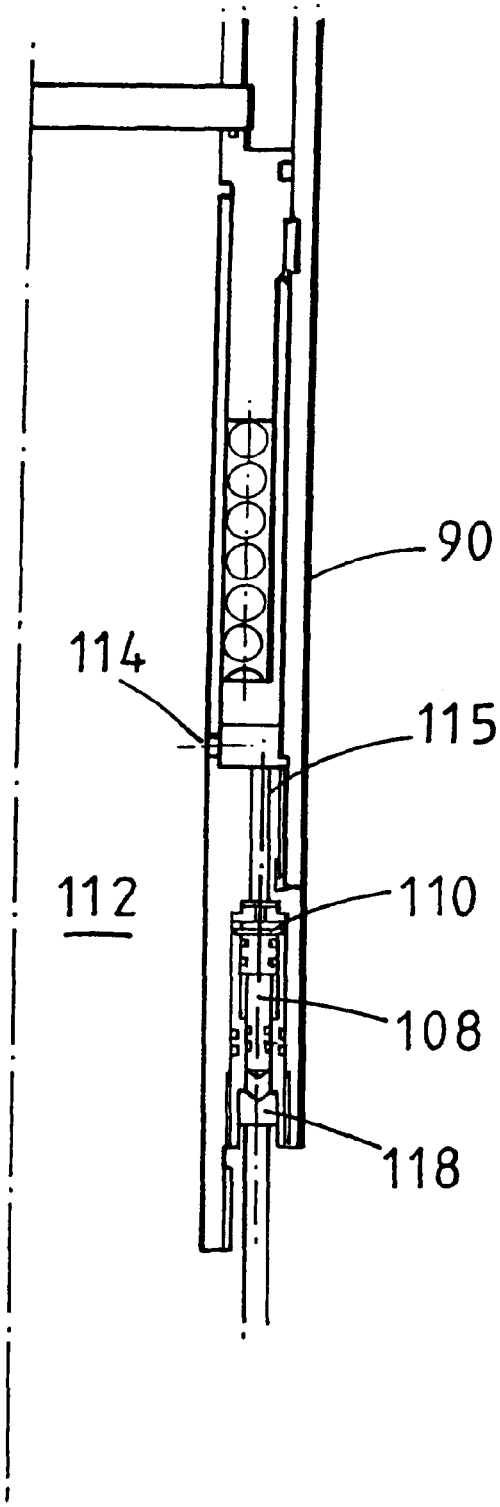

FIGS. 8*a*, 8*b* and 8*c* are half sectional views of a part of the firing system for the gun sections of FIGS. 5 and 6; and FIGS. 9*a* and 9*b* are half sectional views of a further part of the firing system for the gun sections of FIGS. 5 and 6.

Figure 1:
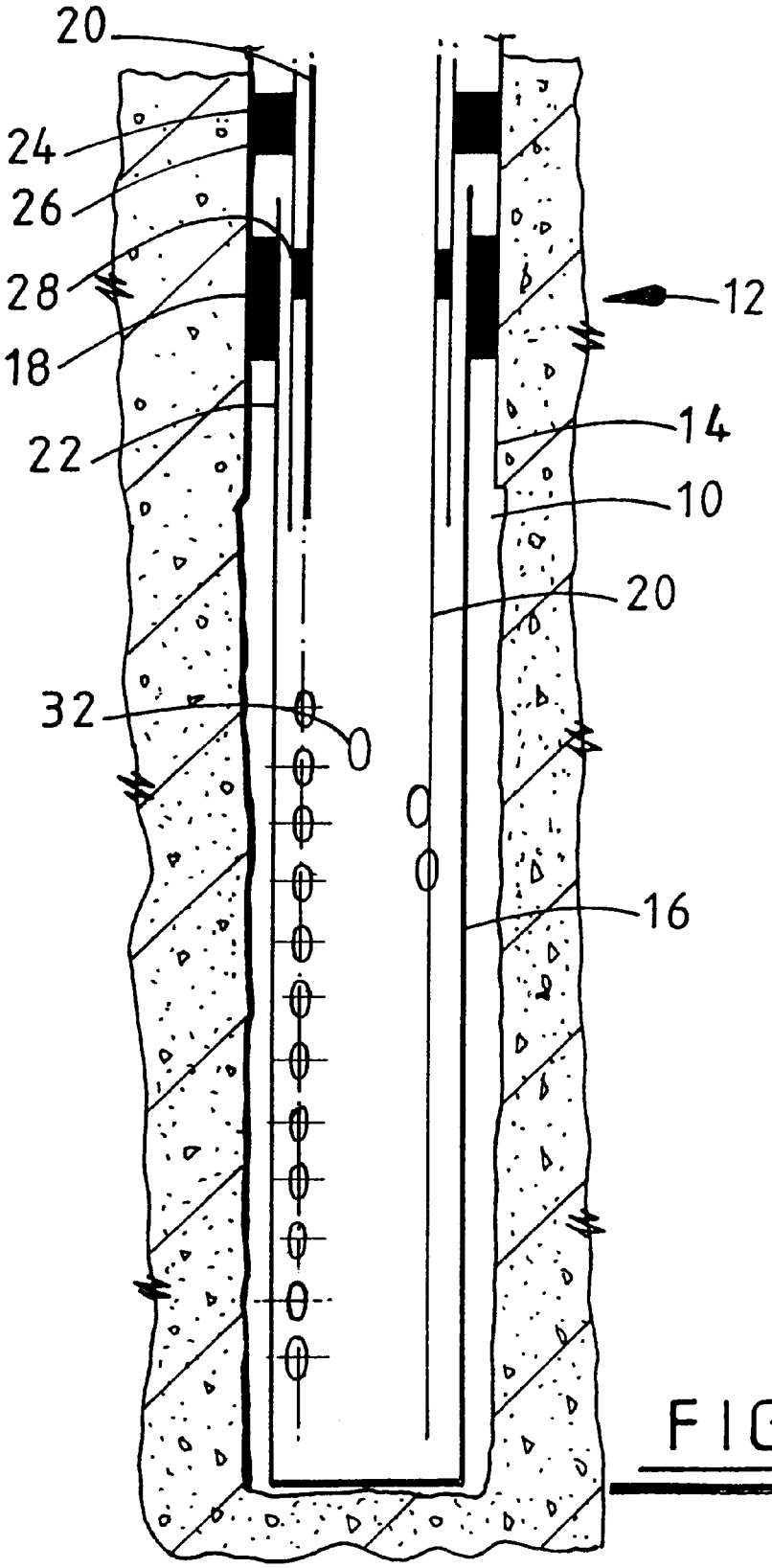
FIG. 1 is a schematic representation of the lower portion of a borehole including apparatus in accordance with an embodiment of one aspect the present invention.

Reference is first made to FIG. 1 of the drawings, which illustrates the lower portion of a borehole 10 and including apparatus 12 in accordance with an embodiment of one aspect of the present invention. The Figure shows the lower end of the borehole casing 14 which lines the borehole 10 over the majority of its length and is set in the borehole using concrete. The casing 14 stops short of the end of the borehole 10 which is initially sealed by a liner 16 located relative to the casing 14 by a liner hanger and seal 18. The liner 16 extends into the oil-bearing formation and is perforated, as will be described, to allow oil to flow from the formation into the borehole 10. The oil is carried to the surface through production tubing 20 which, in this embodiment, extends to the lower end of the borehole 10. The production tubing is located relative to the casing 14 by a retrieval sleeve 22 forming part of the present invention. The retrieval sleeve 22 is located and sealed relative to the casing 14 by locking means 24 and sealing means 26, as illustrated schematically in FIG. 1.

Figure 2:
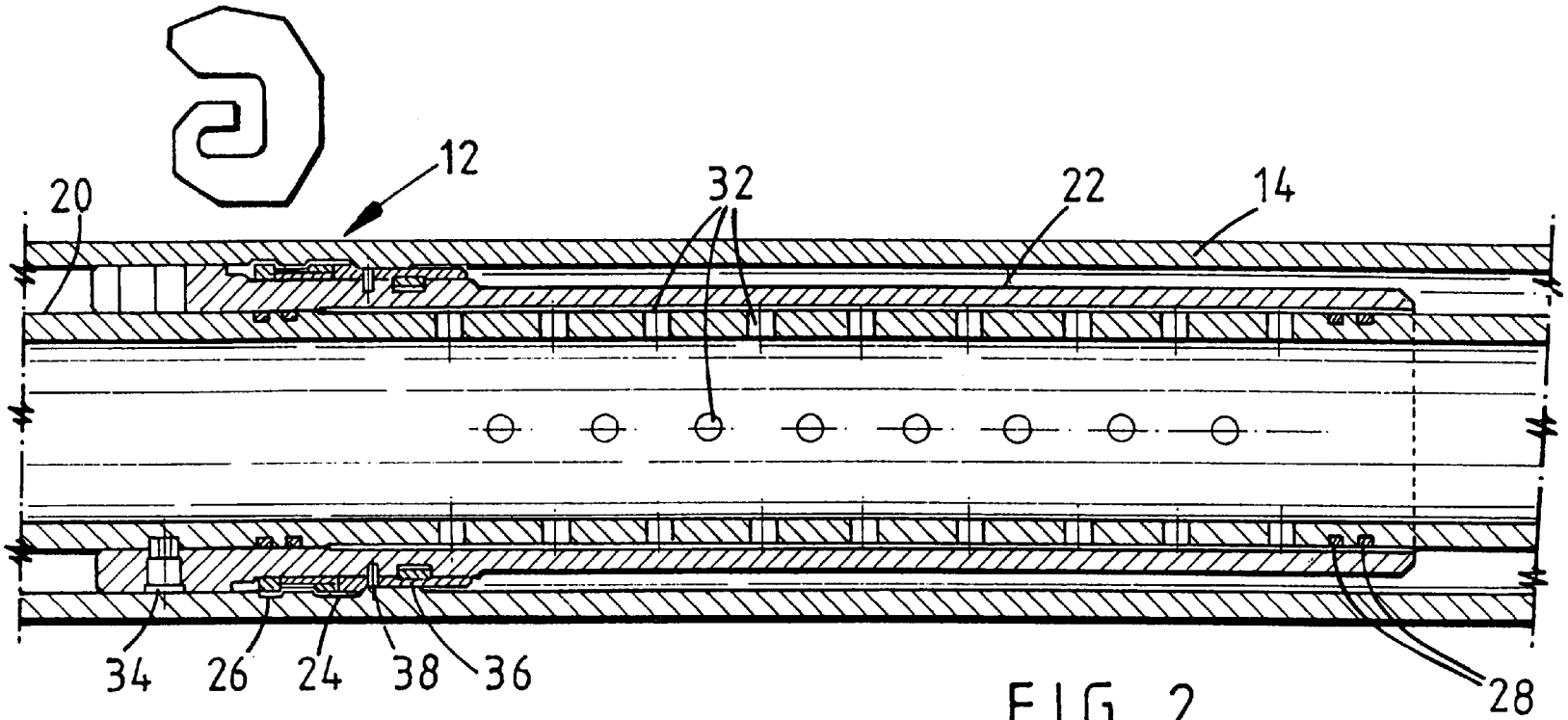
Figures 3, 4:
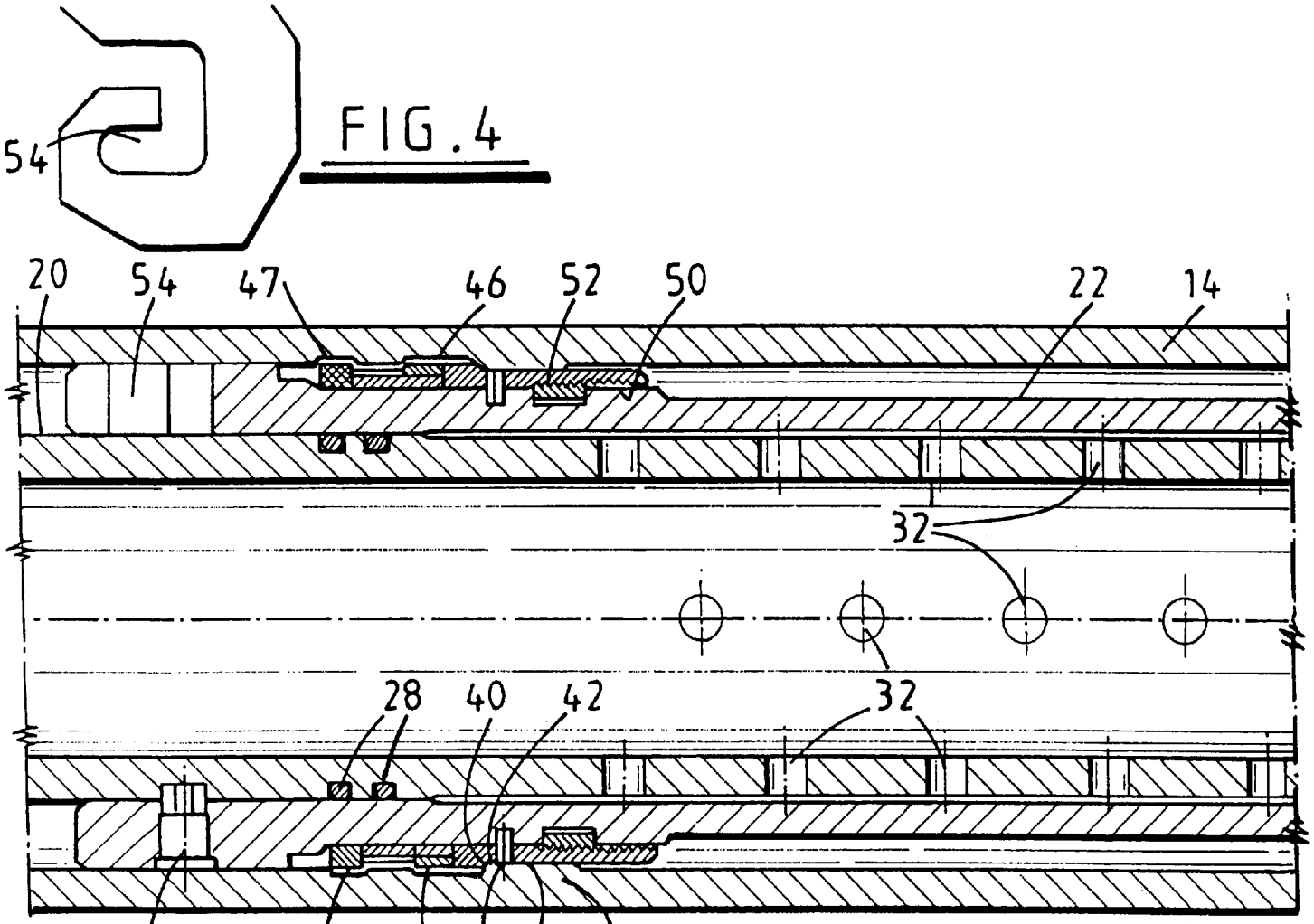
FIG. 3 is a further enlarged sectional view of a portion of the apparatus of FIG. 1.
FIG. 4 is a representation of a retrieval J-slot defined on the apparatus of FIG. 1.

Reference is now also made to FIGS. 2 and 3 of the drawings, which illustrate the sleeve 22 in greater detail. The sleeve 22 is initially carried by a section of the tubing 20 and is run into the borehole 10 on the tubing 20; FIGS. 2 and 3 illustrate the sleeve still fixed relative to the tubing 20.

In this particular embodiment the tubing 20 carries perforating guns for perforating the liner 16, the guns forming the lower end of the tubing 20 and including a large number of strip gun type charges (not shown) located in corresponding apertures 32 in the tube 20. The charges disintegrate following detonation, leaving the apertures 32 as illustrated. The guns are in accordance with one embodiment of another aspect of the present invention, a further embodiment of this aspect of the invention being described separately, with reference to FIGS. 5 to 8 of the drawings.

The sleeve 22 is initially retained on the tubing 20 by a shear pin 34 and a seal is provided between the tubing 20 and the sleeve 22 by completion seals 28.

The sleeve 22 itself carries a landing sleeve 36 which is initially fixed to the sleeve 22 by a shear pin 38. The landing sleeve 36 defines a shoulder 40 for engaging a corresponding shoulder 42 defined by a casing restriction 44. Above the restriction 44 the casing defines two profiles 46, 47 for receiving the sleeve lock means and seal means in the form of a split lock ring 24 and a radially expandable seal 26. The inner face of the landing sleeve 36 defines a ratchet thread 50 for engaging a ratch ring 52 mounted on the sleeve 22.

The upper end of the sleeve 22 defines a retrieval J-slot 54, shown in section in FIG. 3 and also illustrated in FIG. 4 of the drawings.

The sleeve 22 is set in the casing 14 simply by running the tubing 20 and sleeve 22 into the borehole until the landing sleeve shoulder 40 engages the casing shoulder 42. The landing sleeve 36 is thus restrained against further downward movement. Following shearing of the pin 38, the tubing 20 and sleeve 22 continue to move downward relative to the landing sleeve 36 and this relative movement energises the split lock ring 24 and the seal 26. The relative positioning of the sleeves 36, 22 is maintained by the engagement of the ratchet thread 50 and ratch ring 52. Application of further weight to the tubing 20 results in the pin 34 shearing, such that the tubing 20 may now be moved longitudinally relative to the set sleeve 22.

In this particular embodiment, once the sleeve 22 is set, the perforating guns may be located in the liner 16 and the charges detonated to perforate the liner 16. As noted above, the charges will disintegrate following detonating, such that production fluid may then flow through the perforated liner 16 and the apertures 32 into the bore of the tubing 20 and then to the surface.

If the tubing 20 and guns are to be retrieved from the borehole 10, it is merely necessary to pull the tubing 20 upwardly, through the sleeve 22. If the sleeve 22 is to be retrieved, a retrieval tool is lowered into the borehole 10 and manipulated to engage the J-slot 54. The sleeve 22 may then be rotated relative to the landing sleeve to disengage the ratchet thread 50 and ratch ring 52. This de-energises the split lock ring 24 and seal 26 such that the sleeve 22 may be pulled from the borehole.

Reference is now made to FIGS. 5 to 9 of the drawings, which illustrate elements of a perforating system in accordance with an embodiment of a further aspect of the present invention. The apparatus comprises a tubular perforating gun, made up of a plurality of gun sections 60, 61, comprising a section of tubing 62, 63. Apertures 64 are formed in each section of tubing 62, 63, the apertures 64 being arranged in six longitudinal rows (only three rows being visible in FIG. 5). Each aperture 64 accommodates a perforating charge 66 located in the respective apertures 64 by an internally and externally threaded plastic cap 68. The charges 66 in each row are connected by a respective detonation cord 72. As may be seen in FIG. 6, each tubing end 63 is provided with a sleeve 74 which supports a pair of explosive transfer boosters or connectors 76, 77, each of which communicates with three detonation cords 72. The boosters 76, 77 are adapted to co-operate with corresponding boosters provided in the lower end of the adjacent tubing section 62, a male booster in the form of a shaped charge 79 being provided to link the adjacent boosters.

To minimise the effect of poor or faulty links between the boosters in adjacent gun sections the boosters in each section connect to different cords 72. In the absence of this feature it would be possible for a single faulty link to prevent detonation of half of the charges below the fault. However, by varying the cord connections the effects of a faulty link will be minimised as the detonation signal will travel back up the cords from a link below the fault.

The adjacent ends of the tubing sections 62, 63 are connected by means of a threaded sleeve 78 which is initially rotatably mounted on the upper end of the tubing section 63 and defines windows through which the shaped charges 79 may be passed for location in the slotted boosters 76, 77. The sleeve 78 defines an internal thread 80 which is made up to a corresponding external thread 81 on the tubing section 62. Once the threads are made up, grub screws are inserted in threaded bores 82 in the sleeve 78 to lock the sleeve against rotation.

Reference is now made to FIGS. 8*a*, 8*b*, 8*c* and 9*a* and 9*b* of the drawings which illustrate details of the firing system for the gun sections 60, 61. This embodiment of the invention is intended for use with the applicant's full bore isolation valve (FBIV) as described in PCT\GB97\00308. Part of the valve is illustrated in the upper portion of the Figures, the valve including a closure member 84 which is initially held against a lower valve seat 87 by a locked retaining sleeve 88. The valve remains closed while completion testing is carried out on the tubing above the perforating apparatus, and after a predetermined number of pressure cycles the retaining sleeve 88 is unlocked so that it may be retracted by application of bore pressure. As the sleeve 88 is retracted the closure member 84 remains in contact with the valve seat 87 due to the pressure differential across the closure member 84. However, once pressure is bled off above the valve, the closure member 84 opens, and the sleeve 88 is then extended into contact with the valve seat 86, to provide a slick bore. Once the closure member 84 has opened the valve seat 86 may move axially upwardly relative to the valve body 90 under the influence of a spring 92, to allow initiation the firing heads of the perforating system, as described below.

FIG. 8*a* illustrates the valve in the closed position, with the valve seat 86 being held axially relative to the valve body 90 by the locked retaining sleeve 88. The valve seat 86 is formed on the upper end of the sleeve 94, the lower end of which engages the upper end of the spring 92. The lower end of the spring 92 engages a shoulder formed on fingers 98 which extends upwardly between the valve body 80 and the valve seat sleeve 94. The upper end of the fingers 98 are held relative to the valve body 90 by a split ring 100 which is radially supported by the valve seat sleeve 94 to engage with a profile 102 in the valve body 90. The lower end of the fingers 98 provide mounting for a firing pin 104 which extends through a portion of the valve body and is positioned above a firing head 106. The firing head connects to the detonation cord.

On the valve opening, and the valve seat 87 and valve seat sleeve 94 moving upwardly relative to the body 90, an external profile on the sleeve 94 is positioned at the rear of the split ring 100, allowing the ring 100 to collapse inwardly and the fingers 98 to move downwardly under the influence of the spring 92. The downward movement of the finger 98 and firing pin 104 brings the end of the firing pin 104 into contact with the firing head 106. This contact initiates detonation of the charges 66, which will normally occur two to three minutes after the contact taking place.

FIGS. 8*a*, 8*b* and 8*c* illustrates a mechanical firing arrangement, and a somewhat similar firing arrangement is also provided on the apparatus, where movement of a firing pin completes an electrical connection to initiate electrical firing of the charges. Further, the apparatus also includes a hydraulically initiated firing system, as illustrated in FIGS. 9*a* and 9*b* of the drawings. A hydraulic firing pin 108 is provided in the valve body 90 and is initially fixed to the valve body 90 by a rupture disk 110. The upper face of the rupture disk 110 is in communication with the valve bore 112 via a port 114 and a longitudinal passage 115. Thus, if the mechanical or hydraulic firing system should fail, an increase in bore pressure will rupture the disk 110 allowing the firing pin 108 to be pushed downwardly by fluid pressure to engage the respective firing head 118. All of the firing systems may be operated simultaneously, or the systems may be arranged such that they operate individually.

It is preferred that when the charges 66 are detonated the system is underbalanced, that is the fluid pressure within the gun section 60, 61 is lower than the formation pressure, such that the production fluid will tend to wash the debris of the detonated charges 66, cord 72, and boosters 76, 77, 79 upwardly and out of the tubing. Accordingly, if the hydraulically initiated firing system is utilised, the two to three minute delay between the contact of the firing pin 108 with the firing head 118 and the detonation of the charges is utilised to bleed off pressure from the tubing.

As noted above, when detonation of the charges 66 occurs, the individual charges 66 break up to leave the apertures 64 clear, and the detonation also breaks up the cord 72 and the boosters 76, 77, 79. The resulting debris is made up of small, relatively light parts, which may then be washed from the tubing by the formation fluid which flows into the gun sections 60, 61.

It will be clear to those of skill in the art that the above-described embodiments of the present invention provides a cost effective and safe means of perforating a large interval of liner. Mounting the perforating guns on tubing as described above obviates the requirement to run perforating guns separately on wireline, coil tubing or the like and thus saves considerable time. Further, the sleeve 22 of the first described embodiment has a relatively small radial dimension when compared to a conventional packer, such that the gun charges are located close to the liner 16 and thus act more effectively when detonated. Further, in the first described embodiment, the tubing 20 and guns may be released from the sleeve without difficulty, which option is generally not available with conventional packers. In addition, the set sleeve 22 may be retrieved from the borehole 10 without difficulty, in contrast to conventional packers which generally have to be milled out.

It will be clear to those of skill in the art that the apparatus of the embodiments of the present invention may be employed in many other applications in which some or all of the advantages outlined above may be usefully applied. Further, the use of a solid metal sleeve 22 facilitates provision of fluid communication lines through the sleeve. It will also be clear to those of skill in the art that the above-described embodiments are merely exemplary of the present invention, and that various modifications and improvements may be made thereto without departing from the scope of the invention, for example the perforating guns may be mounted on an extended sleeve 22, rather than on the tubing 20, and the perforating guns may be utilised in combination with conventional tubing and inflatable packers.

What is claimed is:

1. Perforating apparatus comprising a length of tubing mounted on the lower end of a length of one of production and test tubing, the wall of the tubing defining a plurality of apertures, and perforating charges being located in the apertures, following detonation the apertures providing fluid communication between the exterior and the interior of the length of tubing so that fluid may flow into the length of tubing via the apertures and then flow upwardly through the length of tubing and into the production or test tubing.

2. The apparatus of claim 1, wherein the charges disintegrate on detonation to form light or small parts which may be swept out of a well by formation fluid.

3. The apparatus of claim 1, wherein, following detonation of the charges, the internal flow area of the tubing corresponds to the tubing internal diameter.

4. The apparatus of claim 1, wherein each charge is locatable in a respective aperture from the tubing exterior.

5. The apparatus of claim 4, wherein each charge includes a cap adapted to engage with a respective aperture.

6. The apparatus of claim 1, wherein the charges are linked by detonation transfer means for communicating a detonation signal to each charge.

7. The apparatus of claim 6, wherein the detonation transfer means extends through the interior of the tubing.

8. The apparatus of claim 1, wherein the tubing is provided in separable tubing sections, each section carrying a number of charges.

9. The apparatus of claim 8, wherein the sections are connected by threaded collars rotatably mounted on the end of one section for engaging a corresponding threaded portion on the end of an adjacent section.

10. The apparatus of claim 9, wherein the sections are provided with connecting boosters for connecting detonation transfer means in adjacent tubing sections.

11. The apparatus of claim 10, wherein the connecting boosters are accessible when the adjacent tubing sections are placed together and a connector completing booster is locatable therebetween.

12. The apparatus of claim 1, further comprising firing means for initiating detonation of the charges.

13. The apparatus of claim 12, wherein he firing means is activated by one or more of an electrical signal, hydraulic pressure or mechanical action.

14. The apparatus of claim 12, wherein the firing means is provided in combination with a valve including a valve portion which is movable on pressure being bled off above the valve and the valve opening, which movement releases a firing pin actuating arrangement.

15. The apparatus of claim 12, wherein the firing means s pressure actuated, and includes a firing pin initially retained by a retainer which releases the firing pin on application of a predetermined fluid pressure thereto.

16. The apparatus of claim 1, wherein a plug is provided at the end of the tubing, which plug is blown from the tube when the charges are detonated.

17. A method of perforating wellbore liner, the method comprising:

providing perforating apparatus comprising a length of tubing, the wall of the tubing defining a plurality of apertures, and perforating charges being located in the apertures;

mounting the perforating apparatus on the lower end of a length of production or test tubing;

positioning the perforating apparatus in a lined section of wellbore; and detonating the charges to open the tubing apertures and perforate the wellbore liner such that formation fluid flows through the apertures and into the tubing, flows upwardly through the length of tubing, and from the tubing flows into the production or test tubing.

18. The method of claim 17, wherein the pressure within the tubing is lower than the pressure in a formation externally of the liner such that, following perforation, fluid from the formation will tend to flow through the apertures into the tubing.

19. Perforating apparatus comprising a length of tubing mounted on the lower end of a length of one of production and test tubing and in fluid communication therewith, and a plurality of perforating charges mounted in the tubing, following detonation apertures in the wall of the tubing providing fluid communication between the exterior and the interior of the length of tubing so that fluid may flow into the length of tubing via the apertures and then upwardly through the tubing and into the production or test tubing.

20. A method of perforating wellbore liner, the method comprising:

providing perforating apparatus comprising a length of tubing, and a plurality of perforating charges mounted in the tubing;

mounting the perforating apparatus on the lower end of a length of production or test tubing;

positioning the perforating apparatus in a lined section of wellbore; and detonating the charges to open apertures in the wall of the tubing and perforate the wellbore liner such that formation fluid flows through said apertures and into the tubing, flows upwardly through the length of tubing, and flows from the tubing into the production or test tubing.

* * * * *